324-77
2/13/79 XR 4,139,895 SR

United States Patent [19]
Kurkjian et al.

[11] 4,139,895
[45] Feb. 13, 1979

[54] ANALOG COMPUTER

[75] Inventors: Charles R. Kurkjian, Bernards Township, Somerset County; George E. Peterson, Warren, both of N.J.

[73] Assignee: Bell Telephone Laboratories, Incorporated, Murray Hill, N.J.

[21] Appl. No.: 826,041

[22] Filed: Aug. 19, 1977

[51] Int. Cl.[2] ..... G06G 7/48
[52] U.S. Cl. ..... 364/802; 324/77 A; 364/554; 364/578; 364/806
[58] Field of Search ..... 364/801, 802, 806, 807, 364/554, 551, 550, 578, 481, 487, 812; 324/77 R, 77 A; 307/350, 360, 362

[56] References Cited

U.S. PATENT DOCUMENTS

| | | | |
|---|---|---|---|
| 3,348,031 | 10/1967 | Russell, Jr. et al. | 364/554 |
| 3,497,684 | 2/1970 | McKiernan | 364/554 |
| 3,626,168 | 12/1971 | Norsworthy | 364/554 X |
| 3,633,009 | 1/1972 | Green et al. | 364/554 |

OTHER PUBLICATIONS

Langenthal-"Analyzing Signals for Information"-Instruments and Control Systems-Dec. 1970-pp. 87-89.

*Primary Examiner*—Joseph F. Ruggiero
*Attorney, Agent, or Firm*—Allen N. Friedman

[57] ABSTRACT

The disclosed device is an analog computer for analyzing data from measurements of physical phenomena or manufacturing processes involving random quantities. The computer includes noise generators whose amplitudes and spectra can be controlled to represent the random variables of the physical system or process under investigation. The random signals, and any periodic signals which may be involved, are fed into the circuit analog of the physical system. The output of the circuit analog is fed into a probability density circuit. The output represents the response of the physical system to the input variables. When the input amplitudes are adjusted to match the output to the measured data, the input levels indicate the relative importance of the input variables to the behavior of the physical system. The computer has been used to analyze the spin resonance line shapes of impurities in glasses. It could be used in a manufacturing setting, for example, to analyze product failure data to determine failure mechanisms dependent upon random variations of processing conditions.

4 Claims, 4 Drawing Figures

ANALOG COMPUTER

BACKGROUND OF THE INVENTION

1. Field of the Invention

The invention is in the field of analog data analysis.

2. Description of the Prior Art

Through the application of probability theory various analytical techniques have been developed to mathematically represent the behavior of physical systems, such as glasses, involving randomly varying quantities (e.g. G. E. Peterson et al. *Physics and Chemistry of Glasses,* 15 (1974)52; *Physics and Chemistry of Glasses,* 15 (1974)59; *Physics and Chemistry of Glasses,* 16 (1975)63). Numerical analytical methods exist by which data taken in observation of such random systems can be analyzed in order to assess the relative importance of the various quantities (both random and periodic) affecting the physical system under investigation (Narita et al, *Journal of Chemical Physics,* 44 (1966)2719). The subject systems vary from such research oriented investigation as nuclear magnetic resonance in glasses to such practical investigations as the distribution of the gains of nominally identical amplifiers made from components, each selected from a bounded random group.

Numerical analysis, however, is a relatively slow process for complex systems particularly for systems involving random variables. The analog device described below is much more rapid. One critical component of this device is a probability density function circuit, such as is described in the literature by P. Ottonello *Journal of Physics* (E) *Scientific Instruments,* 7 (1974)878.

SUMMARY OF THE INVENTION

The device of the invention is an analog computer for analyzing data from measurements of physical phenomena or manufacturing processes involving random quantities. The computer includes one or more noise generators whose amplitudes and spectra can be controlled to represent the random variables of the physical system or process under investigation. The random signals, and any periodic signals which may be involved, are fed into the circuit analog of the physical system. The output of the circuit analog is fed into a probability density calculator circuit. The output represents the response of the physical system to the input variables. When the input amplitudes are adjusted to match the output to the measured data, the input levels indicate the relative importance of the input variables to the behavior of the physical system. The computer has been used to analyze the spin resonance line shapes of impurities in glasses. It could be used in a manufacturing setting, for example, to analyze product failure data to determine failure mechanisms dependent upon random variations of processing conditions.

DETAILED DESCRIPTION

Figure 1:
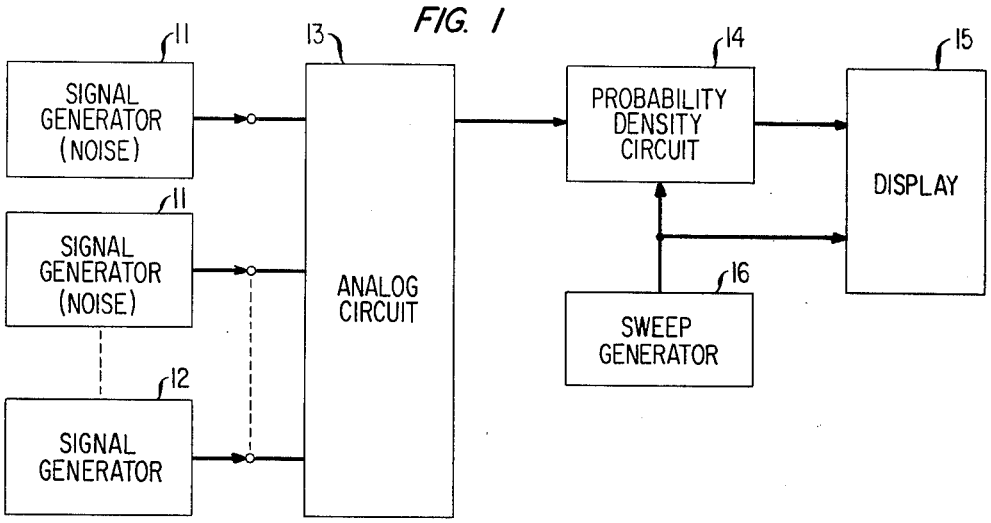
FIG. 1 is a block diagram of an exemplary analog computer of the invention.

The devices described below are analog computers particularly adapted for analyzing physical systems involving random variables. The basic structure of these devices is illustrated in FIG. 1. These computers include one or more noise generators 11 and, possibly, one or more periodic signal generators 12. Each of these signal sources is designed to represent one of the variables of the physical systems under investigation. For variables involving significant uncertainty the noise spectrum is chosen to correspond to the uncertainty distribution of the quantity represented. The periods of the possible periodic signal sources are chosen to correspond to the period of the variable quantity being represented. The amplitudes of the signal generators are adjusted to correspond to the relative strength of the variable quantity of the physical system.

The signal outputs of these generators are fed into an analog circuit 13 which represents the physical system by use of the electrical circuit analog of the interaction of the quantities which characterize the system. The output signal from the analog circuit is fed into a probability density circuit 14. This circuit indicates the relative time spent by the output signal of the analog circuit between the output voltage level V and output voltage level $V+\Delta V$, as V is varied over its range. This measurement, displayed as a function of time, is a measure of the response of the physical system to the random and periodic input variables. The output of the probability density circuit can be displayed on a display device 15 such as the cathode ray tube or a chart recorder. The display can be synchronized with the output of the probability density circuit 14 by driving both devices 14, 15 from the same sweep generator 16.

The mode of operation of this analog computer depends upon what is known and what is unknown about the physical system under consideration. One common mode of operation involves the adjustment of the relative amplitudes of the signal generators 11, 12 feeding a fixed analog circuit 13 in order to match the shape of the curve appearing on the display 15 to data resulting from the actual measurements on the physical system. If only one variable is involved or if the relative strengths are known and the interaction between the variables is the unknown or poorly known quantity, then the analog circuit itself 13 can be varied to match the display 15 to the measure data thus deriving numbers about the interactions within the physical system.

Figure 2:
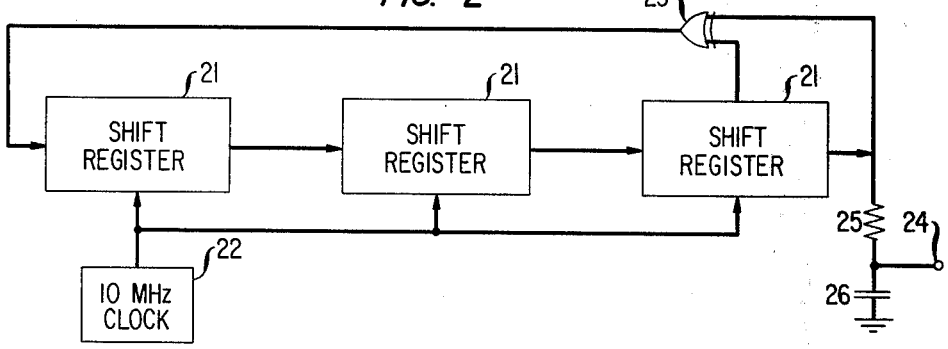
FIG. 2 is schematic diagram of an exemplary noise generator.

Many types of noise generators are known in the art. An exemplary noise generator, which has been used in conjunction with the above described computer is illustrated schematically in FIG. 2. This noise generator includes a series of three 8-bit parallel output serial shift registers 21 driven by a 10 megahertz clock 22 connected, as illustrated, to an exclusive-OR gate 23. At the output 24 there appears a pseudo-random binary sequence with a Gaussian spectral distribution. The resistor 25 and capacitor 26 were chosen to produce a 2 microsecond time constant. Several techniques are known in the art to transform such a Gaussian noise spectrum to other types of spectra. Such a transformation may be needed to properly represent a particular variable of the physical system under consideration. Such techniques are well known in the art and may be found, for example, in "High Speed Analog Computers," R. Tomovic et al, John Wiley & Sons, Inc. (1962) Chapter 6. A truncated spectrum can, for example, be used to represent resistors or other electrical components selected in random between two specific values.

Figure 3:
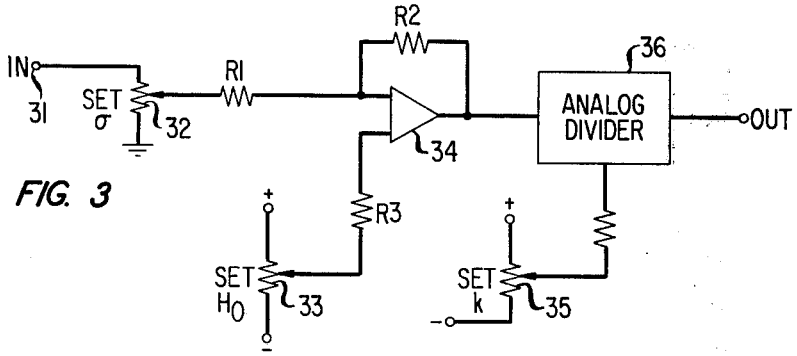
FIG. 3 is a schematic diagram of an exemplary analog circuit.

The analog circuit illustrated in FIG. 3 was designed to represent the interaction between elementary particle spins and a magnetic field. This interaction can be represented by the formula $g=k/H$. In a spin resonance experiment "g" is observed in a fixed value of applied field, H. If the elementary particle spins are located in a paramagnetic glass, the magnetic field observed by each spin as affected by the local value of the magnetic field produced by the glass. This local field varies randomly from location to location through the body of the glass sample. In the analog computer constructed to represent this system the variable magnetic field, H, is represented by a Gaussian noise source of a mean value of $H_o$ and a spread of $\sigma$. In the analog circuit of FIG. 3 the noise source is fed into input 31, the spread, $\sigma$ is set in a potentiometer 32, the general field value, $H_o$, is set in potentiometer 33. The noise signal and $H_o$ are then fed into a differential amplifier 34, the quantity, k, is set to correspond to the experimental conditions in potentiometer 35 and the two signals are fed into an analog divider 36. Such dividers are commonly available as integrated circuit packages.

Figure 4:
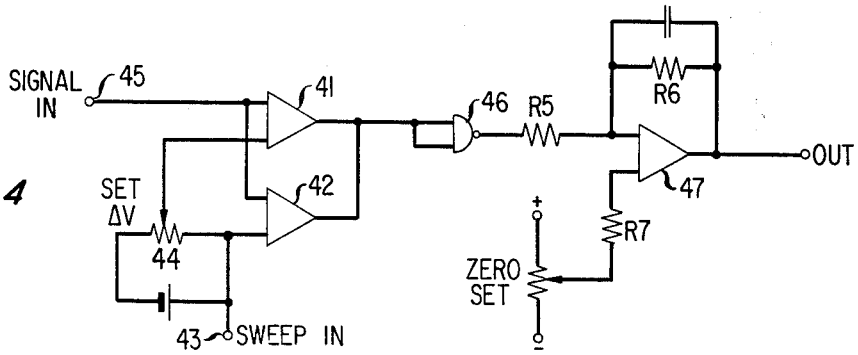
FIG. 4 is a schematic diagram of an exemplary probability density circuit.

An exemplary probability density circuit is shown in FIG. 4. In this circuit a window discriminator is formed of two differential amplifiers 41,42. The noninverting input of the upper amplifier 41 and the inverting input of the lower amplifier 42 are swept by a signal commonly derived from a sweep input 43 offset by a fixed voltage. This offset voltage is set in potentiometer 44. The output of the analog circuit is fed into the input 45 of the window discriminator. An exemplary discriminator was swept at a rate of once per second. The output of the window discriminator is high for inputs between two threshold levels and low for signals above and below the two threshold levels. The window between the threshold levels is swept through its range slowly relative to the frequency of the signal appearing in the input 45. A pulse shaper may be used in the linking network in the output of the window discriminator to insure that the amplitudes of the output pulses of the window discriminator are independent of the pulse length. In the exemplary circuit, the pulse shape is produced by commonly driving the inputs of a positive NAND gate 46. The pulses from the window discriminator are fed into an integrator 47 whose time constant is short relative to the sweep input to terminal 43 and long relative to the frequency of the signal input into terminal 45. An exemplary integrator had a time constant of 4 milliseconds. This probability density circuit then indicates the relative amount of time spent by the input signal 45 within the voltage window as the window is swept over its range by the sweep input 43. The output of the integrator can then be displayed on a display device swept by the same sweep generator as is fed into terminal 43.

What is claimed is:

1. An analog computer comprising at least one signal generator, including at least one noise generator, each for producing an electrical signal representing a physical variable of a set of physical variables of a subject physical system; a physical phenomenon analog circuit for accepting the signals and producing an intermediate signal, the analog circuit being electrically connected to the at least one signal generator, the analog circuit representing the interaction between the physical variables and the subject physical system; and a probability density circuit for accepting the intermediate signal and producing an output signal representing the response of the subject physical system to the set of physical variables, at least one of which is random, the probability density circuit being electrically connected to the analog circuit.

2. A device of claim 1 in which the at least one signal generator includes at least one periodic generator.

3. A device of claim 1 in which the probability density circuit includes a window discriminator, an integrator, and a linking network, electrically connecting the window discriminator and the integrator.

4. A device of claim 3 in which the linking network includes a pulse shaper.

* * * * *